United States Patent [19]

von Hagen et al.

[11] Patent Number: 4,631,095

[45] Date of Patent: Dec. 23, 1986

[54] STEEL THAT IS EXPOSED TO HYDROGEN SULFIDE

[75] Inventors: Ingo von Hagen, Krefeld; Hans-Georg Hillenbrand, Düsseldorf; Rolf K. Popperling, Mülheim, all of Fed. Rep. of Germany

[73] Assignee: Mannesmann AG, Duesseldorf, Fed. Rep. of Germany

[21] Appl. No.: 726,799

[22] Filed: Apr. 24, 1985

[30] Foreign Application Priority Data

Apr. 24, 1984 [DE] Fed. Rep. of Germany ..... 3415590

[51] Int. Cl.[4] ..... C21D 7/08

[52] U.S. Cl. ..... 148/12 F; 148/12.3

[58] Field of Search ..... 148/12 F, 12.3

[56] References Cited

U.S. PATENT DOCUMENTS

| | | | |
|---|---|---|---|
| 4,354,882 | 10/1982 | Greer | 148/12 F |
| 4,370,178 | 1/1983 | Waid et al. | 148/12 F |
| 4,388,123 | 6/1983 | Murayama et al. | 148/12 F |
| 4,394,189 | 7/1983 | Greer | 148/12 F |
| 4,414,042 | 11/1983 | Gross et al. | 148/12 F |
| 4,494,999 | 1/1985 | Gräf | 148/12 F |

*Primary Examiner*—Wayland Stallard

*Attorney, Agent, or Firm*—Ralf H. Siegemund

[57] ABSTRACT

A ferritic perlite steel is used for pipes and tubing to be highly resistant against stress corrosion cracking when exposed to $H_2S$, and having following alloying range, all percentages by weight: from 0.3 to 0.45 C, from 1.4 to 1.8 Mn, from 0.2 to 0.5 Si, from 0.2 to 0.5 Cr, from 0.04 to 0.1 V, up to 0.06 Nb, ≦0.003 S, the remainder being iron whereby the combined Niobium and Vandium content must obey the rule that the sum of the V content plus twice the Nb content must not be not less than 0.1%; tubing is made by hot working followed by cooling in air from the final temperature attained during hot working, so that a texture and grain size in accordance with ASTM finer than 8 obtains; the tubing has strength value of 552 N/mm²≦0.2% of rupture elongation limit ≦655 N/mm² and a tensile strength exceeding 655 N/mm².

3 Claims, 1 Drawing Figure

CRITICAL TENSILE STRENGTH FOR HSCC (HYDROGEN INDUCED STRESS CORROSION CRACKING $H_2S$-SOLUTION (pH=3)) # V.S. YIELD STRENGTH (0,2% RUPTURE ELONGATION)

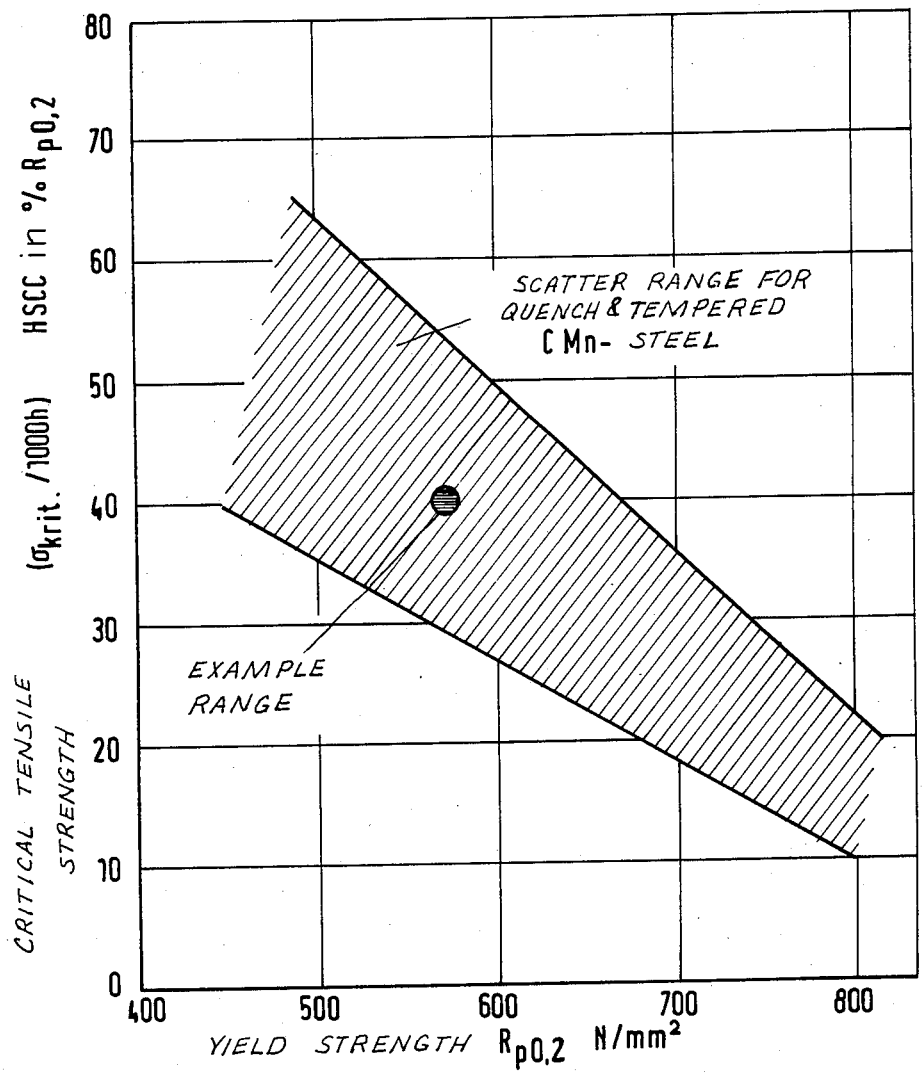
CRITICAL TENSILE STRENGTH FOR HSCC (HYDROGEN INDUCED STRESS CORROSION CRACKING $H_2S$- SOLUTION (pH=3)) # V.S. YIELD STRENGTH (0,2% RUPTURE ELONGATION)

STEEL THAT IS EXPOSED TO HYDROGEN SULFIDE

BACKGROUND OF THE INVENTION

The present invention relates to tubing and pipe which are required to be highly resistant against stress corrosion cracking particularly when exposed to hydrogen sulfide.

Generally speaking steel is known to include certain ranges for the alloying elements, carbon, manganese, silicon, chromium, vanadium and nitrogen as disclosed for example in German printed patent application No. 31 27 373. Steel of this type is known to have a yield strength between 480 and 650 N/mm$^2$. This property however presupposes that the completed steel product has been subjected to a particular programm of deformation and thermal treatment. The type of steel is characterized by the fact that upon making tubes from a hollow and particularly prior to a final longitudinal rolling step the hollow tube has to be cooled to a temperature between the so called Ac1 level and somewhere above 500° C. For the final stretch reducing rolling pass the product is reheated to a temperature above Ar3. The resulting product meets the quality requirements in accordance with API specification N80.

It has to be pointed out however that grade N80 steel is not required nor expected to be resistent against hydrogen sulfide and steel of this type is not expected particularly to be used for example for conducting such a fluid. Therefore grade N80 steel is not expected to have a reliable resistance against stress corrosion cracking. Accordingly API has introduced the grade L80 for use in conjunction with acid gas. Grade L80 steel however has certain limits in its technical properties as compared with grade N80 steel and its hardness is limited to a maximum value of HRC22, and it has annealed grain texture (quenching and tempering). The annealing used here is comprised of quench hardening followed by tempering. This final treatment of the product requires a considerable amount of energy and it is also quite time consuming and is, therefore, regarded as a draw back for this particular kind of product.

DESCRIPTION OF THE INVENTION

It is an object of the present invention to establish a steel alloy for the making of tubing which has an adequate resistance against stress corrosion cracking when exposed to hydrogen sulfide, well above the grade N80 type steel; therefore it is a particular object of the present invention to find alloy ranges in conjunction with a thermal treatment so as to obtain a fine grain ferritic-perlite texture and grain structure having resistance against stress corrosion cracking just as quenched and tempered steel has with comparable yield strength.

Therefore in accordance with the preferred embodiment of the present invention a method of using a particular steel for pipes and tubing to be highly resistant against stress corrosion cracking when exposed is proposed and comprises the steps of using a ferritic perlite steel within the following alloying range, all percentages by weight:

from 0.3 to 0.45 C
from 1.4 to 1.8 Mn
from 0.2 to 0.5 Si
from 0.2 to 0.5 Cr from 0.04 to 0.1 V
up to 0.06 Nb
≦0.003 S
the remainder being iron whereby the combined Niobium and Vandium content must obey the rule that the sum of the V content plus twice the Nb content must not be not less than 0.1%; tubing is made from said steel by hot working followed by cooling in air from the final temperature attained during hot working so that a texture and grain size in accordance with ASTM finer than 8 obtains and the tubing has strength value of 552 N/mm$^2$≦0.2% yield strength limit of rupture elongation≦655 N/mm$^2$ for a tensile strength exceeding 655 N/mm$^2$.

In view of the desireability of a higher ratio of yield strength to tensile strength, of quenched and tempered steel as compared with ferritic perlite steel, the latter have a higher tensile strength and are therefore harder for same yield strength. The texture and grain structure of the aforementioned steel has a maximum hardness of HRC26. In addition these steel have a comparable resistance against stress corrosion cracking as quenched and temper hardened steel with HRC22. This condition however has not been practiced with a heretofore customary material having moreover the required mechanical strength. Literature has not disclosed any such utilization.

The present invention avoids the subsequent quenching and tempering and is to be seen in the selection of a particular alloy range of steel which has been cooled in air from a temperature obtained during hot working, while possibly after the hot rolling a normalizing-annealing treatment was interposed and therefore fullfills the requirements of a tight yield strength range as well as a high resistance against hydrogen induced stress corrosion cracking. Therefore the manufacture of a product such as a tube or pipe for the conduction of hydrogen-sulfide containing material is considerably simplified.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereo will be better understood from the following description taken in connection with the accompanying drawings in which:

The FIGURE illustrates a diagram in which critical tensile strength for hydrogen induced stress corrosion cracking in an $H_2S$ solution with pH Value of 3 in dependance upon the yield strength, 0.2% of the rupture elongation limit.

The particular example whose characteristic values are property indicated in the FIGURE is a steel having the following composition (all % by weight).

0.38% C
1.53% Mn
0.37% Si
0.32% Cr
0.08% V
0.034% Nb
0.002% S
the remainder being iron.

A steel of this type is heated to a hot rolling temperature of 1250° C. and was subsequently rolled to obtain a tube dimension of 139.7×7.7 mm. Prior to the last rolling pass the steel was cooled to a temperature below 550° C. until a complete transformation of grains occured, following which the product was reheated to a rolling temperature of 920° C. whereupon rolling was completed. Thereafter the product, at whatever temperature it had at the end of rolling, was simply cooled in air.

The particular strength values obtained were as follows: the 0.2% rupture elongation and yield strength limit was 570 $N/mm^2$ at a tensile strength of 810 $N/mm^2$. The hardness value was HRC23 and the grain size was on the average with ASTM 10.

The tubing made in this manner was subsequently tested concerning resistance against hydrogen induced stress corrosion cracking, particularly in a $H_2S$ containing solution with a pH=3. After a 1000 hr test a critical limit stress value for stress corrosion cracking was obtained being 40% of the yield strength. This limit stress is therefore, as can be seen from the FIGURE, well within the scatter range for quenched and tempered carbon manganese steel having the same strength grade with HRC22.

The invention is not limited to the embodiments described above, but all changes and modifications thereof, not constituting departures from the spirit and scope of the invention are intended to be included.

We claim:

1. Method of making steel pipes and tubing to be highly resistant against stress corrosion cracking when exposed to H2S, comprising the steps of:

using a ferritic perlite steel within the following alloying range, all percentages by weight:

from 0.3 to 0.45 C from 1.4 to 1.8 Mn from 0.2 to 0.5 Si from 0.2 to 0.5 Cr from 0.04 to 0.1 V up to 0.06 Nb not more than 0.003 S the remainder being iron whereby the combined Niobium and Vanadium content must obey the rule that the sum of the V content plus twice the Nb content must not be not less than 0.1%;

making tubing from said steel by hot working; and cooling in air the hot worked tube from a final temperature attained during hot working so that a texture and grain size in accordance with ASTM finer than 8 obtains and the tubing has strength value of 552 N/square mm≦0.2% of rupture elongation ≦655 N/square mm and a tensile strength exceeding 655 N/square mm.

2. Method as in claim 1, wherein said hot working includes a normalizing step pursuant to which prior to the final hot working step, the tubing is cooled to a temperature below 600° C., down to possibly room temperature; reheating to 850° C. and cooling in air.

3. Method as in claim 1, wherein said hot working is a hot rolling operation; and wherein prior to the last rolling step and pass, the tubing is cooled to a temperature between 600 degrees C. and 400 degrees C.; reheated from that temperature to a temperature above 850 degrees C.; subjected to the final rolling step and cooled in air.

* * * * *